US011401140B1

(12) United States Patent
Jensen et al.

(10) Patent No.: US 11,401,140 B1
(45) Date of Patent: Aug. 2, 2022

(54) LIFTING DEVICE FOR PIPES

(71) Applicants: Steve Jensen, Chilliwack (CA); Doug Jensen, Chilliwack (CA)

(72) Inventors: Steve Jensen, Chilliwack (CA); Doug Jensen, Chilliwack (CA)

( * ) Notice: Subject to any disclaimer, the term of this patent is extended or adjusted under 35 U.S.C. 154(b) by 0 days.

(21) Appl. No.: 17/358,842

(22) Filed: Jun. 25, 2021

(51) Int. Cl.
*B66F 3/44* (2006.01)

(52) U.S. Cl.
CPC ..... *B66F 3/44* (2013.01)

(58) Field of Classification Search
CPC .... B66F 3/08; B66F 7/025; B66F 3/44; B66F 3/16; B66F 3/18; B66F 2700/04
USPC ..... 254/30, 90, 100, 102, 103
See application file for complete search history.

(56) References Cited

U.S. PATENT DOCUMENTS 1,497,046 A * 6/1924 Trusler ..... B66F 7/025 254/92
2,843,222 A * 7/1958 Villars ..... B66F 7/025 187/210
5,009,287 A * 4/1991 Starr ..... B66F 7/04 187/213
5,318,154 A * 6/1994 Hellman, Jr. ..... B66F 7/02 187/203
5,855,360 A * 1/1999 Wurdack ..... B66F 3/08 254/133 R
7,771,155 B2 * 8/2010 Thiel ..... B62H 3/12 414/672
7,861,424 B2 * 1/2011 Munroe ..... G01B 11/26 33/286
9,150,395 B2 * 10/2015 Kritzer ..... B66F 3/46
10,781,089 B2 * 9/2020 Finkbeiner ..... B66F 7/28
2015/0232311 A1 * 8/2015 Taylor ..... B66F 7/28 254/89 R

* cited by examiner

*Primary Examiner* — Lee D Wilson
*Assistant Examiner* — Alberto Saenz
(74) *Attorney, Agent, or Firm* — Borden Ladner Gervais LLP; Michael Damiani

(57) ABSTRACT

A lifting device configured with a linear bearing system operatively associated with a support system configured for raising, lowering and positioning pipes for installation, service, or removal.

8 Claims, 6 Drawing Sheets section A-A of fig.3

LIFTING DEVICE FOR PIPES

BACKGROUND OF THE INVENTION

Plumbers and pipefitters often encounter significant difficulties in the performance of their tasks. One particular difficulty relates to the positioning of pipes prior to their being fixed into an installed configuration. Pipes are typically significantly elongated cumbersome to maneuver and difficult to hold into position for permanent attachment. There is a need in the profession for a simple to use yet effective device for lifting pipes and positioning them prior to installation.

The present invention addresses this need.

SUMMARY OF THE INVENTION

In one embodiment, the device will cradle the underside of pipe and lift it in conjunction with either a pipe laser or slopping laser, in order to get it to proper elevation before bedding material is placed.

In one embodiment, the present invention is configured to work in conjunction with a construction/ pipe laser to raise and lower material to a set grade In a preferred embodiment, the present invention is configured to work with a sloping laser to set pipe to elevation.

The device is unique in allowing the pipe working process (e.g., installation, removal, and maintenance) to be performed by a smaller number of workers than pipe working without using the device.

In a preferred embodiment the present invention is configured as follows:

Battery operated mounted on side
Uses linear actuator to raise and lower
Has up/down remote
Pivoting foot at base for uneven surface
Support for material you are lifting
Internal lifting and lowering using one square tube slight smaller than the other to move freely Although the device as described relates to pipes, it is contemplated that the device be suitable for any one or combination of:

Raise /lower pipe to elevation
Form work
Holding material while fastening
Lifting and lowering In one embodiment, the present invention is a lifting device comprising:

- an upright support having a foot on a lower end of said support;
- an outer tube having an interior cavity to engage said upright support therein, linear bearing system configured in said interior cavity for slidably engaging said upright support along an axis of movement, and wherein said outer tube has a lifting arm support plate connected thereto; and
- a pair of lifting arms pivotally connected to said lifting arm support plate.

In one embodiment, the linear bearing is controlled by an actuator operatively associated with a gear motor.

In one embodiment, the linear bearing is controlled by a hard wired actuator operatively associated with a gear motor.

In one embodiment, the linear bearing is controlled by a wireless actuator operatively associated with a gear motor.

In one embodiment, the pair of lifting arms are pivotally connected to said lifting arm support plate in a manner such that imparting tension on said pair of lifting arms moves and maintains their position selected by a user.

In one embodiment, the device further comprising a stationary rotating laser at one end of said pipe and emit a stationary single beam laser inside said pipe in a manner to be detected by a receiver, wherein said receiver transmits information to a user relating to either raise said pipe, lower said pipe, or maintain position.

In one embodiment, the upright support has a threaded interior cavity, and the lifting device further comprises a threaded inner post that threadably engages with the threaded interior cavity and has an upper end that attaches to the outer tube whereby rotational movement of said threaded inner post slidably moves said outer tube relative to the upright support along the axis of movement.

In one embodiment, the present invention is a lifting device consisting of:

- an upright support having a foot on a lower end of said support;
- an outer tube having an interior cavity to engage the upright support therein, the outer tube having a linear bearing system configured in said interior cavity for slidably engaging said upright support along an axis of movement, and wherein the outer tube has a lifting arm support plate connected thereto; and
- a pair of lifting arms pivotally connected to said lifting arm support plate.

In one embodiment, the linear bearing is controlled by an actuator operatively associated with a gear motor.

In one embodiment, the linear bearing is controlled by a hard wired actuator operatively associated with a gear motor.

In one embodiment, the linear bearing is controlled by a wireless actuator operatively associated with a gear motor.

In one embodiment, the pair of lifting arms supports are pivotally connected to said lifting arm support plate in a manner such that imparting tension on said pair of lifting arms moves and maintains their position selected by a user.

In one embodiment, the device further comprising a stationary rotating laser at one end of said pipe and emit a stationary single beam laser inside said pipe in a manner to be detected by a receiver, wherein said receiver transmits information to a user relating to either raise said pipe, lower said pipe, or maintain position.

In one embodiment, the upright support has a threaded interior cavity, and the lifting device further comprises a threaded inner post that threadably engages with the threaded interior cavity and has an upper end that attaches to the outer tube whereby rotational movement of said threaded inner post slidably moves said outer tube relative to the upright support along the axis of movement.

DETAILED DESCRIPTION OF THE PREFERRED EMBODIMENTS

Figure 1:
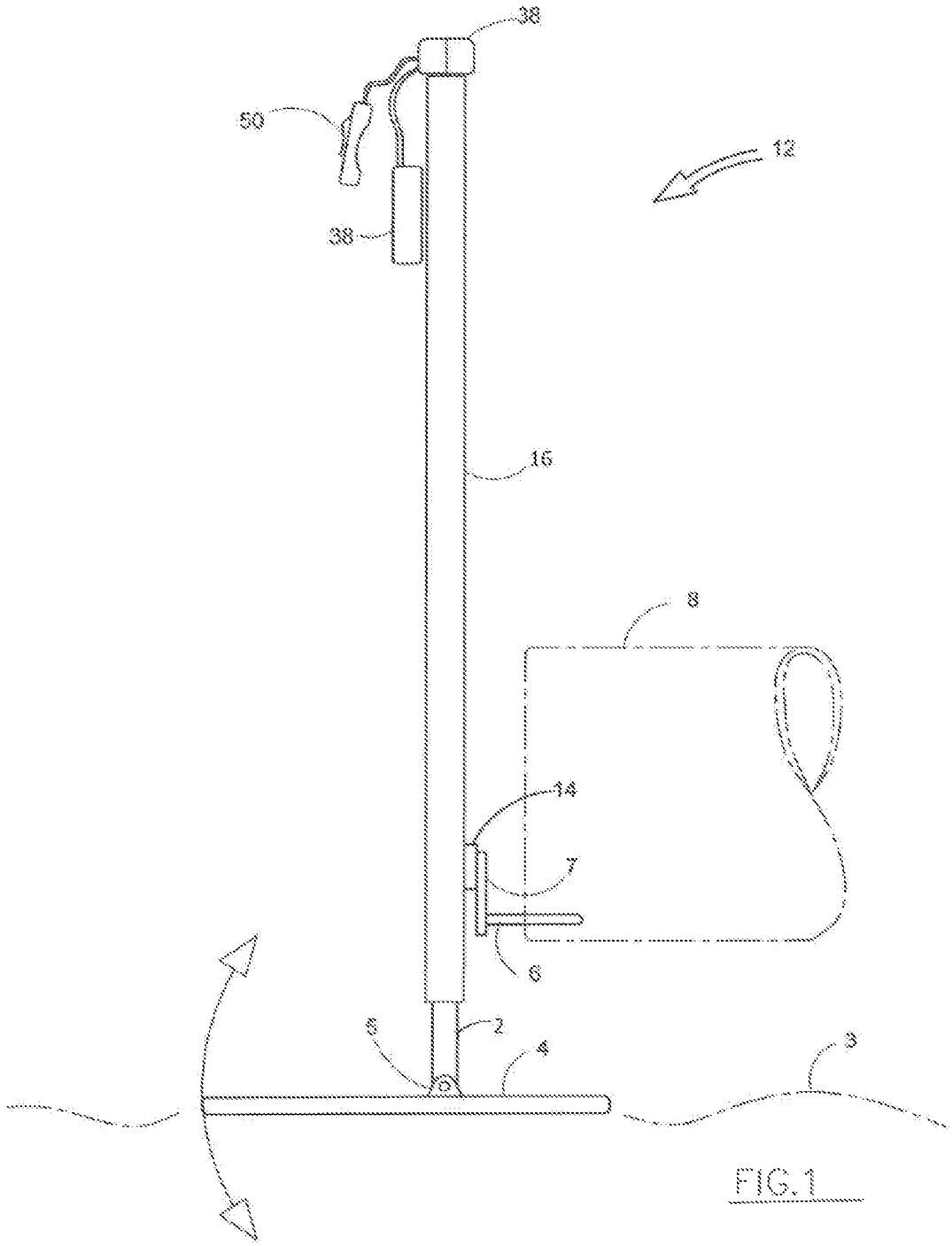
FIG. 1 is an exploded side view of the pipe lifting device according to one embodiment of the present invention.
Figure 2:
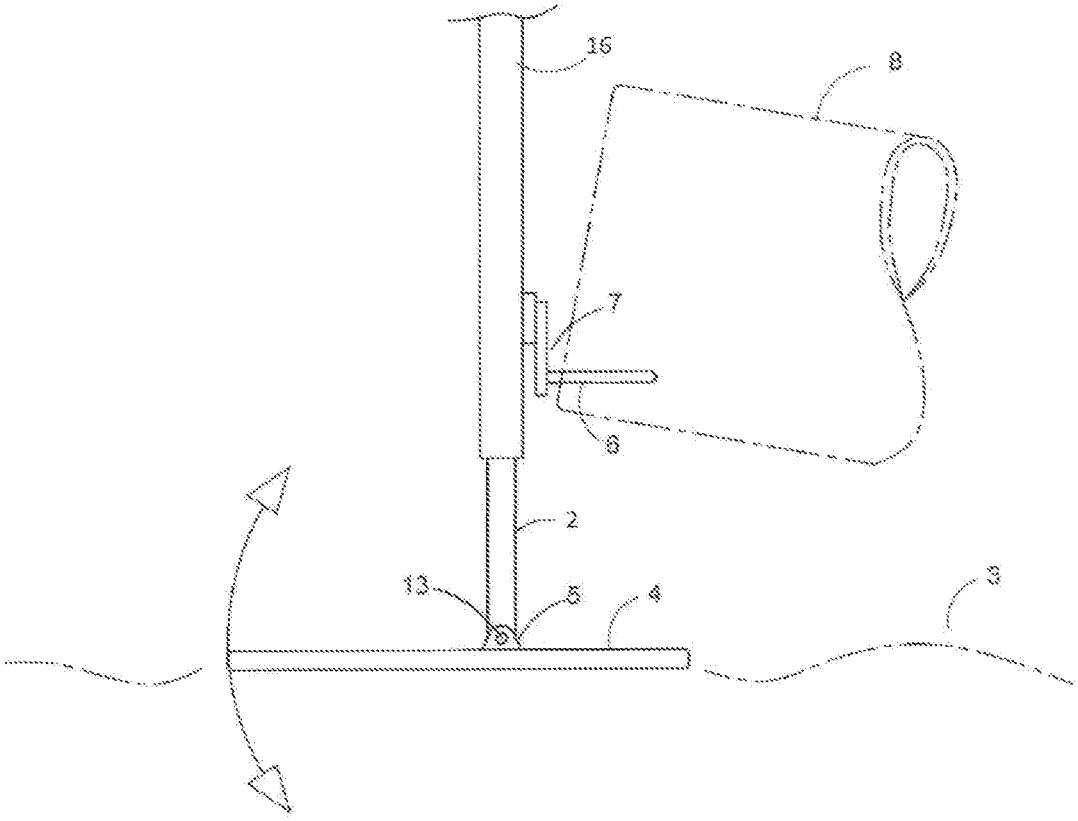
FIG. 2 is a partial side view of the pipe lifting device according to one embodiment of the present invention.
Figure 3:
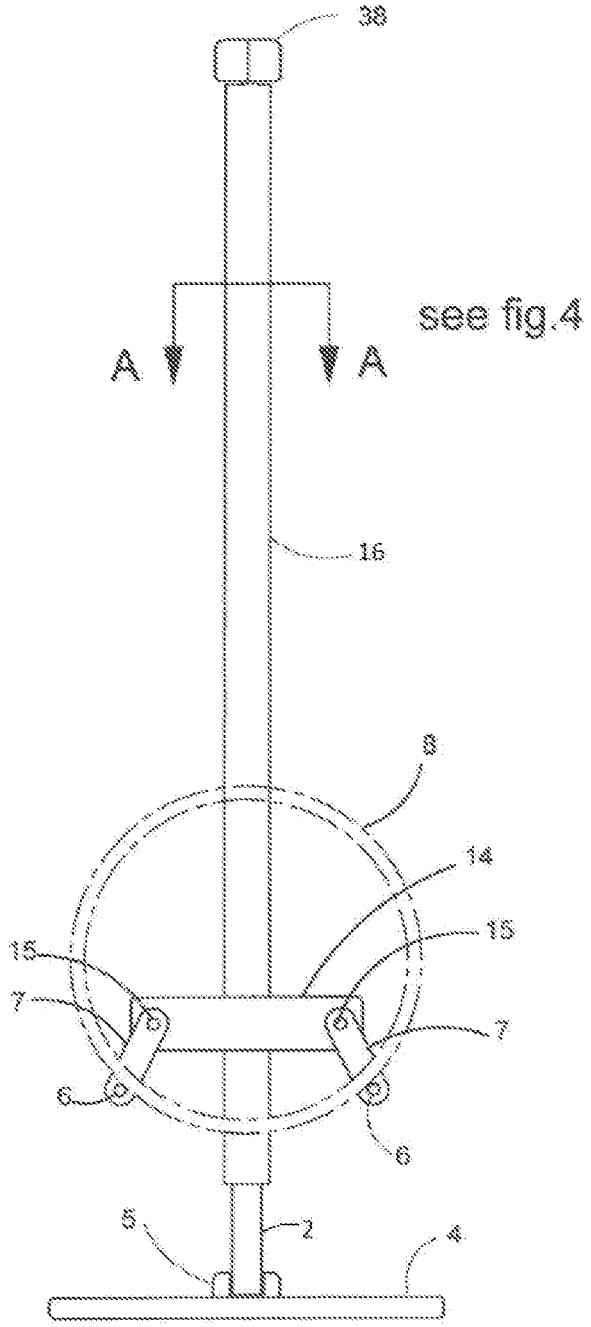
FIG. 3 is a front view of the pipe lifting device according to one embodiment of the present invention.
Figure 4:
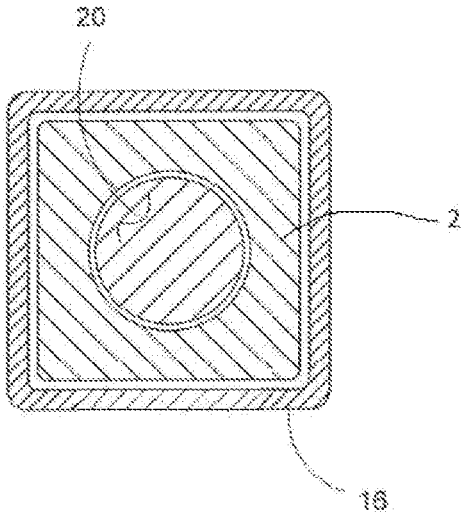
FIG. 4 is a sectional view showing the threaded bar interacting with the inner square and threaded bore according to one embodiment of the present mention.
Figure 5:
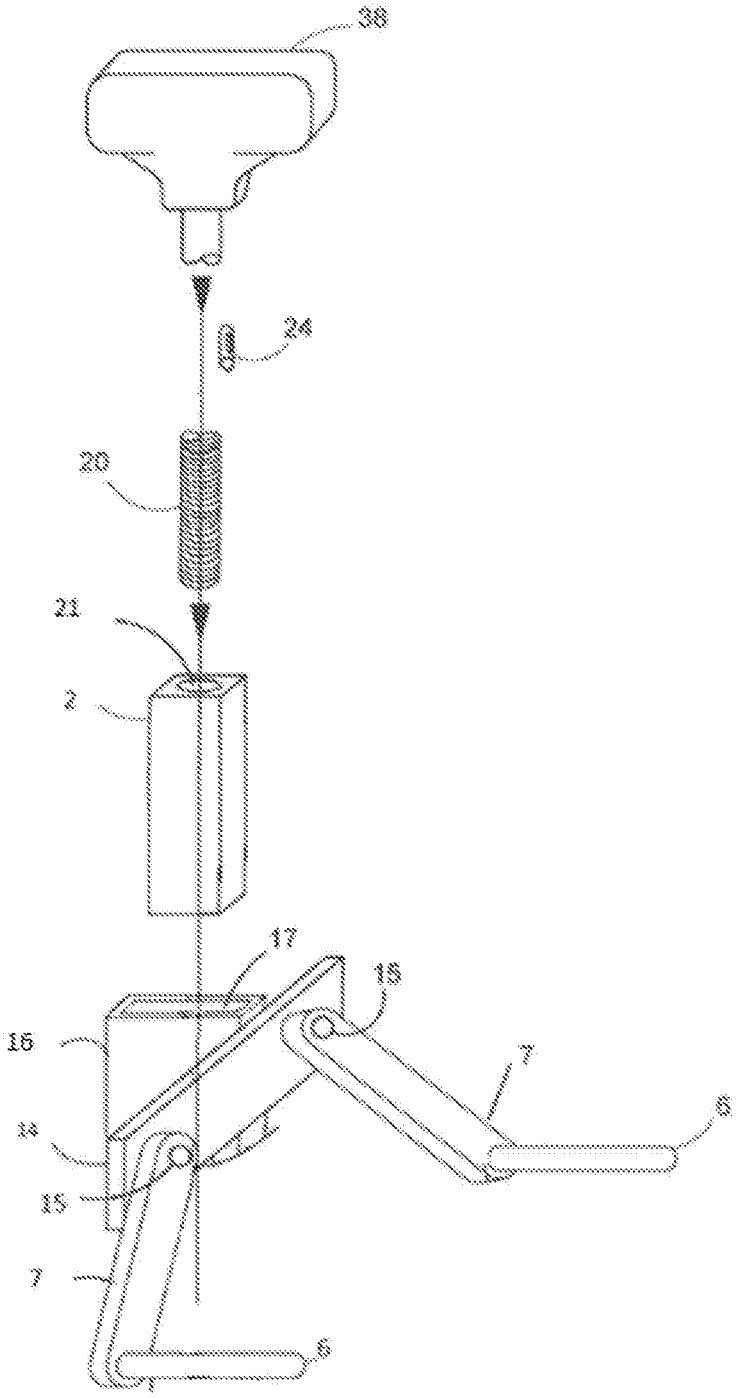
FIG. 5 is an exploded view demonstrative of a control system according to one embodiment of the present invention.
Figure 6:
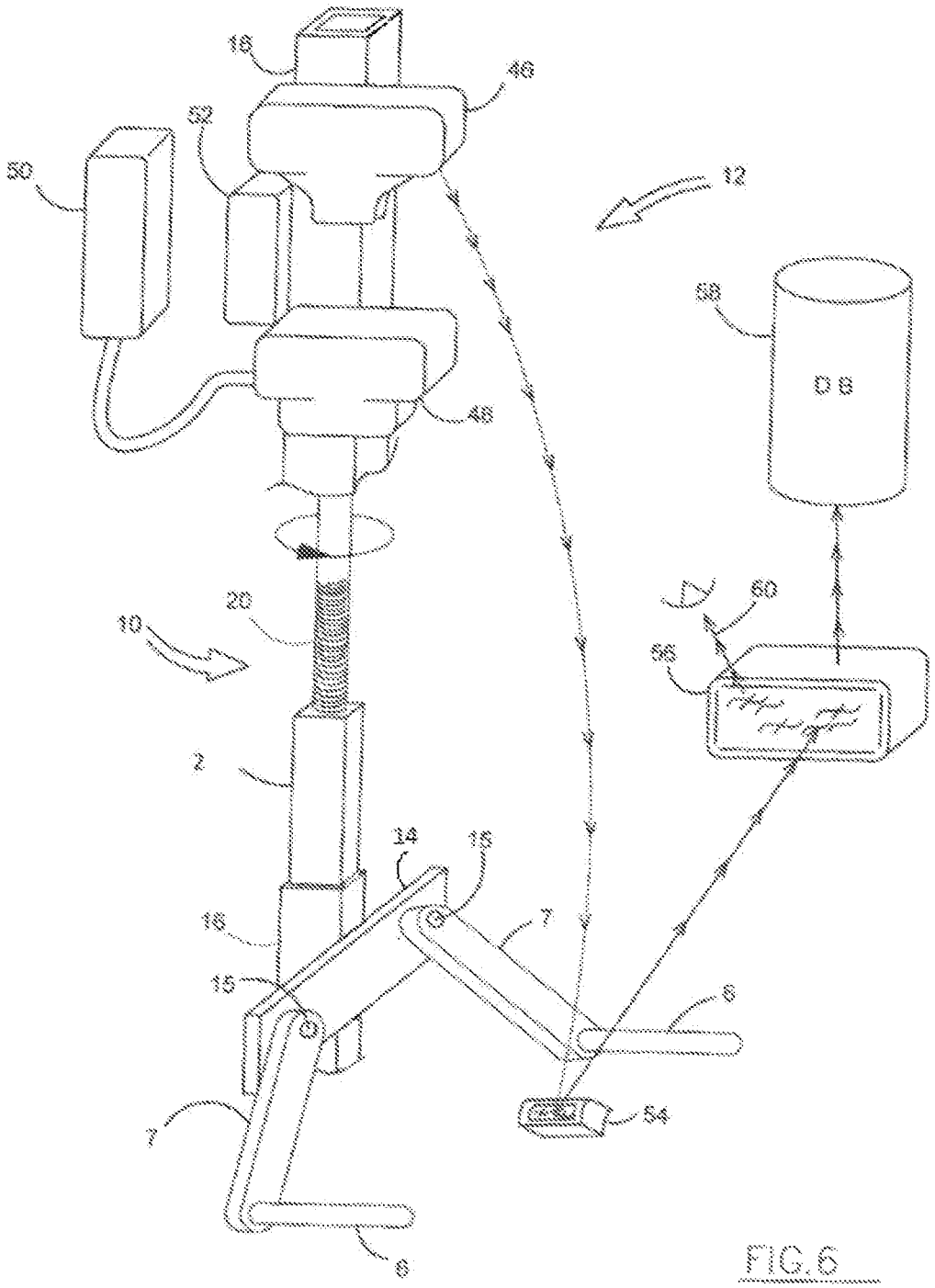
FIG. 6 is a partial view demonstrating the pipe lifting system utilizing a laser target according to one embodiment of the present invention.

As generally understood and demonstrated by the figures, the system includes upright support 2 that is rested on a floor 3 utilizing foot 4. The system utilizes foot connection pivot 5 about pivot pin 13 on the lower end of upright support 2 that supports the entirety of the system while in use. Lifting arm 6 is constructed and arranged to support pipe 8. Lifting arm 6 is supported by lifting arm support 7 and is attached to support plate 14 at pivot 15. In a preferred embodiment, pivot 15 is pivotably attached with tension such that each lifting support arm 7 is positioned and held in place. The positioning is based on the size of pipe 8 or other workpiece used in the present invention.

The system further includes outer tube 16 that is formed with an internal cavity 17 constructed and arranged to accommodate the upright support 2. As demonstrated, upright support 2 has an interior threaded bore 21 configured for interacting with threaded inner post 20.

The device of the present invention further incorporates a linear bearing system for movement of the lifting assembly. Linear bearings are preferred in the present invention as they generate less friction than sliding bearings so they can use a smaller motor and drive system.

Linear bearing assembly 10 includes the linear motion imparted when gear motor 10 is actuated. The actuation of gear motor 10 engages actuator 48 that is operatively associated with threaded inner post 20 and rotates threaded inner post 20 ultimately raising or lowering lifting plate 14 and pipe 8 resting on lifting arms 6.

Gearmotor 38 is controlled by on-off actuator 50.

In a preferred embodiment, the system further includes a laser measuring device 46 that will be aimed at laser target 54. A display device 56 interacting with a memory database 58 and visual read out 60 being included in the system.

In use, system 12 is stood upright with foot 4 on floor 3. The system is helped by a user or supported by a support device. A workpiece, shown as pipe 8, is rested on a pair of lifting arms 6. Although the figures and the general description show a pipe, the invention is contemplated as suitable for any workpiece needing to be raised, lowered, and held in place. On off control 50 is engaged which starts actuator 48 and rotates threaded inner post 20. The configuration of the linear bearing system 10 is such that rotation of threaded inner post 20 moves outer tube 16 and plate 14 attached thereto.

Movement of plate 14 raises and lowers pipe 8 resting on lifting arms 6.

In one embodiment, a user will set up a stationary rotating laser and the end of pipe 8 and run or a stationary single beam laser inside pipe 8 and the receiver picks up the laser to tell an operator to either raise or lower pipe 8. That is to say, a stationary rotating laser at one end of said pipe and emit a stationary single beam laser inside said pipe in a manner to be detected by a receiver, wherein said receiver transmits information to a user relating to either raise said pipe, lower said pipe, or maintain position.

In one embodiment, a memory data base or device 58 will work in conjugation with a GPS total station that is configured to track all locations and elevations of pipe set with this device so municipalities/ contractors would have exact locations of all underground services While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

What is claimed:

1. A lifting device comprising:

an upright support having a foot on a lower end of said support;

an outer tube having an interior cavity to engage the upright support therein, the outer tube having a linear bearing system configured in said interior cavity for slidably engaging said upright support along an axis of movement, and wherein the outer tube has a lifting arm support plate connected thereto; and a pair of lifting arms, wherein each of the pair of lifting arms is pivotally connected to said lifting arm support plate at a pivot point about which the lifting arm is pivotable in a plane that is about parallel to the axis of movement.

2. The lifting device of claim 1 wherein said linear bearing system is controlled by an actuator operatively associated with a gear motor.

3. The lifting device of claim 1 wherein said linear bearing system is controlled by a hard wired actuator operatively associated with a gear motor.

4. The lifting device of claim 1 wherein said linear bearing system is controlled by a wireless actuator operatively associated with a gear motor.

5. The lifting device of claim 1 wherein the pair of lifting arms are pivotally connected to said lifting arm support plate in a manner such that imparting tension on said pair of lifting arms moves and maintains their position selected by a user.

6. The lifting device of claim 1 further comprising a laser measuring device in communication with a receiver, wherein said receiver transmits information from the laser measuring device to a user relating to the position of the lifting arm support plate.

7. The lifting device of claim 1, wherein the upright support has a threaded interior cavity, and the lifting device further comprises a threaded inner post that threadably engages with the threaded interior cavity and has an upper end that attaches to the outer tube whereby rotational movement of said threaded inner post slidably moves said outer tube relative to the upright support along the axis of movement.

8. The lifting device of claim 1, wherein each of the pair of lifting arms comprises a lifting arm support connected to the lifting arms and the lifting arm support plate.

* * * * *